US007213729B2

(12) United States Patent
Machlica

(10) Patent No.: US 7,213,729 B2
(45) Date of Patent: May 8, 2007

(54) GARMENT HANGER

(75) Inventor: John W. Machlica, Binghamton, NY (US)

(73) Assignee: Chatham Communications Corporation, Fairport, NY (US)

( * ) Notice: Subject to any disclaimer, the term of this patent is extended or adjusted under 35 U.S.C. 154(b) by 248 days.

(21) Appl. No.: 10/775,454

(22) Filed: Feb. 10, 2004

(65) Prior Publication Data

US 2005/0173474 A1 Aug. 11, 2005

(51) Int. Cl.
*A41D 27/22* (2006.01)

(52) U.S. Cl. ..... 223/85

(58) Field of Classification Search ..... 223/85, 223/88, 92, 95, 97, 98
See application file for complete search history.

(56) References Cited

U.S. PATENT DOCUMENTS

| | | | | | |
|---|---|---|---|---|---|
| 491,062 | A | | 1/1893 | Granger | |
| D29,038 | S | | 7/1898 | Heaton | |
| 952,202 | A | | 3/1910 | Klingenfeld | |
| 1,797,364 | A | | 3/1931 | Porter | |
| 2,378,922 | A | | 6/1945 | Grant | |
| 2,609,977 | A | | 9/1952 | Lausch | |
| 2,827,211 | A | | 3/1958 | Bradley | |
| 2,884,171 | A | | 4/1959 | Knuth | |
| 3,638,890 | A | | 2/1972 | Burrell et al. | |
| 3,866,810 | A | * | 2/1975 | Florian | 223/98 |
| 4,040,545 | A | * | 8/1977 | Hill | 223/85 |
| 4,160,516 | A | * | 7/1979 | Rice | 223/98 |
| 4,300,688 | A | | 11/1981 | London et al. | |
| 4,606,482 | A | * | 8/1986 | McHugh | 223/88 |
| 4,624,396 | A | | 11/1986 | Universe | |
| 4,632,287 | A | * | 12/1986 | Bevelander | 223/98 |
| 4,738,381 | A | | 4/1988 | Marcin | |
| 4,944,436 | A | * | 7/1990 | Moen et al. | 223/98 |
| 5,038,978 | A | | 8/1991 | Kolton et al. | |
| 5,056,694 | A | * | 10/1991 | Michalik | 223/98 |
| 5,071,045 | A | | 12/1991 | Hollis | |
| 5,085,358 | A | | 2/1992 | Lam | |
| 5,145,098 | A | | 9/1992 | Tung | |
| 5,649,653 | A | | 7/1997 | Joseph | |
| 5,718,362 | A | | 2/1998 | Silverman | |
| 5,738,255 | A | | 4/1998 | Wilms | |
| 5,758,806 | A | | 6/1998 | Anderson | |
| 5,806,727 | A | | 9/1998 | Joseph | |

(Continued)

OTHER PUBLICATIONS

Andrei Guruianu. No more wrinkles. Doc's Hang-All Hanger—Newspaper article from Press & Sun Bulletin at least as early as Feb. 10, 2004.

(Continued)

*Primary Examiner*—Gary L. Welch
*Assistant Examiner*—Andrew W. Sutton
(74) *Attorney, Agent, or Firm*—Harter Secrest & Emery LLP; Brian B. Shaw, Esq.; Stephen B. Salai, Esq.

(57) ABSTRACT

A garment hanger having a frame, wherein a polymeric sheath defining a garment contacting surface is located over a portion of the frame. The polymeric sheath can be of a cellular structure. A further garment hanger includes an overchannel sized to increase the garment contacting surface, wherein the overchannel engages the frame. The frame can include a continuous convex surface extending from a hook to a transverse strut.

20 Claims, 5 Drawing Sheets

U.S. PATENT DOCUMENTS 6,012,620 A * 1/2000 Murray ..... 223/98
6,036,062 A 3/2000 von Fabris auf Mayerhofen
6,053,379 A 4/2000 Balph
6,126,049 A * 10/2000 Gish ..... 223/96
6,206,255 B1 3/2001 Turner
6,260,746 B1 7/2001 Abdi
6,296,160 B1 10/2001 Murray
6,840,413 B1 * 1/2005 Cameron et al. ..... 223/98

OTHER PUBLICATIONS

Home Trends, 2003: Catalog pages.
www.ImprovementsCatalog.com—Quick & Clover Problem Solvers! Jun. 2003. 2 catalog pages.
Doc's Hang-All Hangers. www.docshangall.com. 1 catalog page, at least as early as Feb. 10, 2004.

* cited by examiner

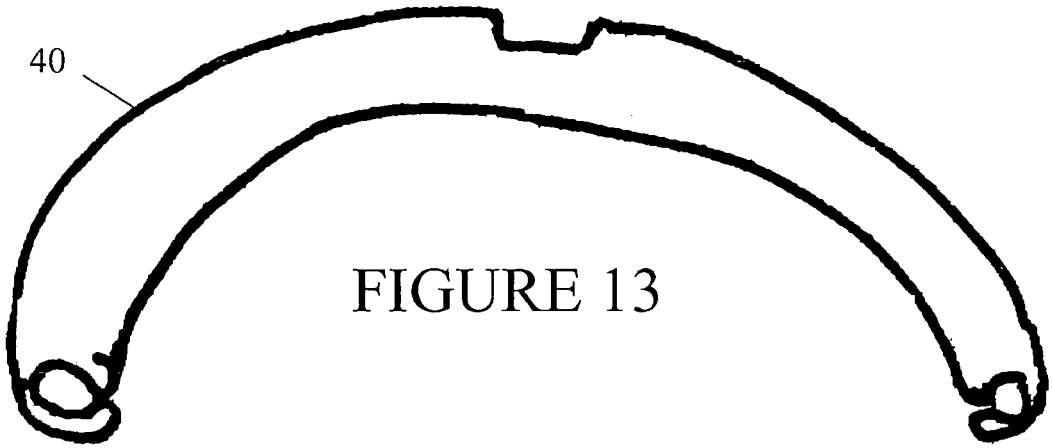
FIGURE 13
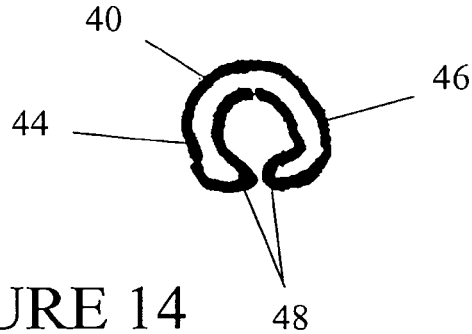
FIGURE 14
FIGURE 15
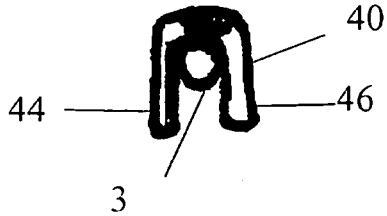

GARMENT HANGER

CROSS-REFERENCE TO RELATED APPLICATIONS

None.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to garment hangers and, more particularly, to garment hangers having a low cost frame for reducing garment deformation, and a secondary garment contacting surface for engaging the frame, wherein the garment contacting surface is selected to reduce undesirable deformation of garments retained by the hanger.

2. Description of Related Art

Plastic garment hangers are widely used for the purpose of shipping and displaying garments. Particularly, in the garment manufacturing industry, such a hanger is often an inexpensive ship-on type, whereby the garment is shipped from the manufacturer or wholesaler to the retailer while suspended from the hanger. Generally, such garment hangers are single-piece or unitary plastic structures adapted to be either discarded at the time of sale, returned to the garment manufacturer, or provided to a customer free of charge in conjunction with the purchase of the suspended garment.

Alternatively, a metal wire is bent into a hanger shape having a hook; a pair of depending, diverging garment contacting arms; and a horizontal strut extending horizontally between terminal ends of the diverging arms. These metal hangers are also relatively inexpensive and are often single use devices. The performance of these metal hangers contributes to the single use of the hangers. For example, terminal ends of the arms of the metal hangers will create puckers or bumps in the shoulder/sleeve of a garment disposed on the hanger. This problem is especially acute with the garment is damp or moist when disposed on the hanger. Further, moist garments tend to enhance oxidation, or rust, of the metal hanger, thereby potentially staining the garment.

Therefore, the need exists for a relatively inexpensive garment hanger with increased performance. The need also exists for a garment hanger that can provide increased contact length with the garment to reduce distortion of the garment, including puckering. A need also exists for a garment hanger that can be formed in accordance with existing technologies, so as to be efficiently produced, wherein the hanger can be modified to significantly increase performance and perceived value. The need also exists for a hanger accessory that can be readily manufactured and engaged with a preexisting hanger to increase the capability of the hanger.

BRIEF SUMMARY OF THE INVENTION

The present invention provides an improved garment hanger, which can be economically manufactured to provide enhanced performance characteristics. The present invention also includes an accessory to an existing hanger, wherein the performance and capacity of the existing hanger is increased.

In one configuration, the garment hanger includes a frame formed to provide a hook; a pair of depending, diverging garment engaging arms; and an interconnecting strut, typically horizontally disposed to interconnect terminal ends of the garment engaging arms. The frame has substantially continuously curvilinear portions selected to reduce deformation or puckering of a garment hung from the frame. Preferably, at least the terminal ends of the garment engaging arms define a continuously curvilinear profile. However, it is understood the garment engaging arms form a curvilinear profile. The frame can thus define a continuous convex surface for contacting the garment. Further, the garment engaging arms are sized such that the terminal ends of the arms are at least approximately 21 inches apart. In addition, the curvilinear configuration of the frame can be effectively "oversized" with respect to industry standard hanger sizing. The garment hanger is constructed to dispose the garment engaging arms intermediate the strut and the hook.

In one configuration, a polymeric sheath is disposed along at least a portion of one of the garment engaging arms. The polymeric sheath can have any of the variety configurations including encapsulation, concentric mounting, and eccentric mounting as well as overmolding. The polymeric sheath can have a substantially constant cross section along its length. Alternatively, the polymeric sheath can be overmolded to provide a varying cross section along a longitudinal dimension of the polymeric sheath.

An alternative configuration, an overchannel, is constructed to cooperatively engage the existing hanger. The overchannel has a generally U-shaped cross section, a longitudinal axis, and an aperture sized to receive the hook. In one construction, the overchannel extends beyond terminal ends of the garment engaging arms of the frame and is sufficiently rigid to support the garment beyond the terminal ends of the arms. Further, the overchannel can define a substantially different contact length than the underlying arms of the hanger. It is further contemplated the curvilinear frame can be employed with either the polymeric sheath or the overchannel.

BRIEF DESCRIPTION OF THE SEVERAL VIEWS OF THE DRAWING(S)

FIG. 13 is a side elevational, partial perspective view of another configuration of the overchannel.

FIG. 14 is an end view of the overchannel of FIG. 13.

FIG. 15 is a cross-sectional view of another configuration of the overchannel operably engaged with the hanger frame.

DETAILED DESCRIPTION OF THE INVENTION

Figure 1:
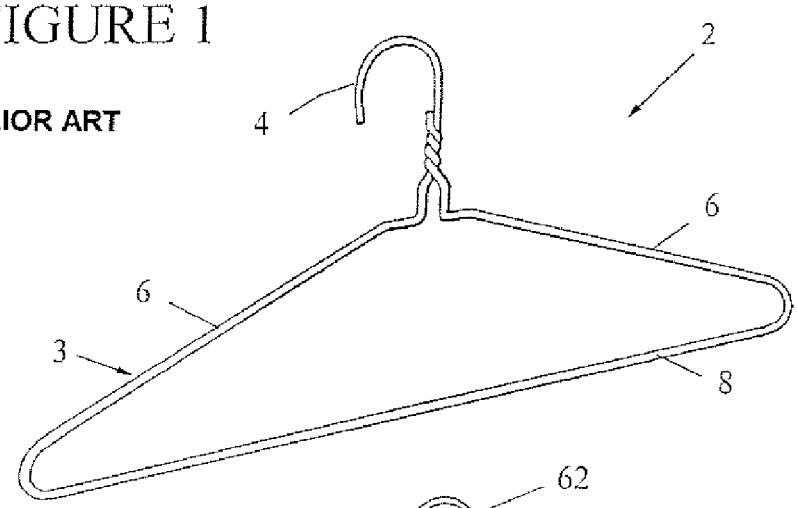
FIGURE 1 PRIOR ART
FIG. 1 is a side elevational view of a traditional garment hanger.

Referring to FIG. 1, a traditional garment hanger 2 includes a frame 3 having a hook 4, a pair of depending garment engaging arms 6, and a transverse strut 8. Typically, the entire garment hanger 2 is formed of a single piece of wire or metal. The wire is often shaped to define the hook 2, the arms 6, and the strut 8, wherein one end of the wire forms a free end of the hook 2 and the remaining end of the wire is wrapped about the frame intermediate the hook and the junction of the arms 6.

Figure 2:
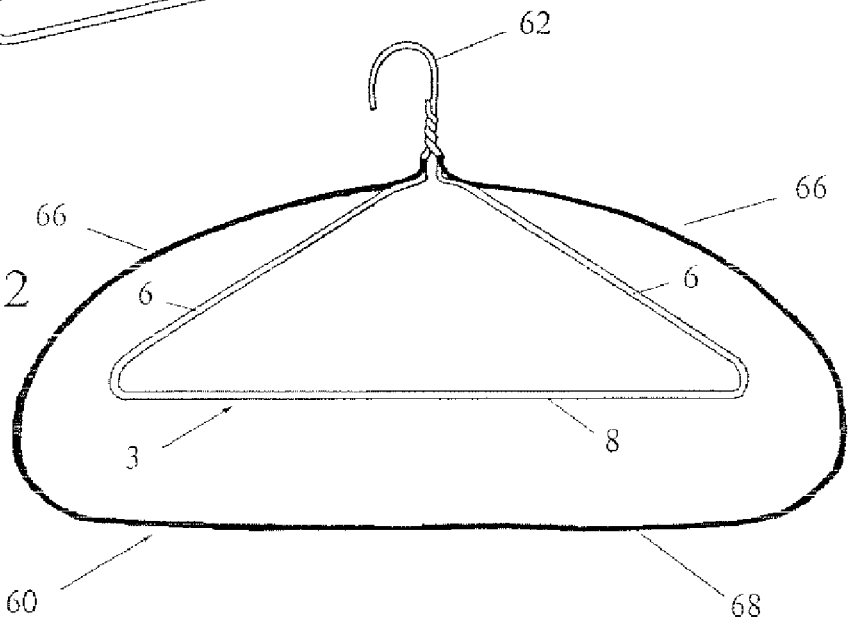
FIG. 2 is a side elevational view of a frame of the present invention in comparison to an industry standard metal frame.

Referring to FIG. 2, the present invention contemplates a curvilinear frame 60. The curvilinear frame 60 includes a hook 62, a pair of depending garment engaging arms 66, and an interconnecting strut 68. The frame 60 can be formed of any of a variety of materials, including but not limited to wire, plastic, or composites. However, it is believed that wire can provide a cost efficient material for forming the frame 60.

The garment engaging arms 66 are constructed to define the width of the frame 60. The garment engaging arms 66 include a continuously curvilinear profile and extend from the ends of the strut 68 to the hook 62. The garment engaging arms 66 define the maximum width of the frame, wherein the strut 68 defines the lowest portion of the frame 60. Preferably, at least the portions of the garment engaging arms 66 that define the maximum width of the hanger are continuously curvilinear. However, it is understood at least substantially that the entire length of the garment engaging arms can be curvilinear. The curvilinear profile of the garment engaging arms 66 is selected to minimize or preclude deformation or puckering of the garment, typically associated with the garment draping to locate the effective center of mass of the unsupported portions of the suspended garment beyond the terminal ends of the garment engaging arms. That is, the center of mass of the portion of a sleeve that does not contact the garment engaging arms 66 is beyond (or at) the terminal ends (maximum width) of the arms, rather than swinging to drape between the terminal ends of the arms. Thus, the garment engaging arms 66 are sized to locate the center of mass of any unsupported portion of the garment beyond the maximum width of the hanger, as defined by the garment engaging arms. Alternatively stated, the garment engaging arms 66 define a greater width than the strut 68. As seen in FIG. 2, the strut 68 defines the bottom portion of the hanger 60, yet the horizontal dimension of the strut is less than the horizontal dimension of the garment engaging arms 66. That is, the strut 68 is the portion of the frame 60 that is vertically spaced furthest from the hook 62, and the strut 68 has a smaller horizontal dimension than the garment engaging arms 66. The garment engaging arms 66 are thereby disposed intermediate the hook 62 and the strut 68.

In a preferred configuration, the garment engaging arms 66 define a width of at least approximately 21 inches. In contrast, prior hangers have a width of approximately 16 inches. The strut 68 can have a length of approximately 16 inches. Thus, as seen in FIG. 2, the garment engaging arms 66 curve towards each other as the arms extend beyond the maximum width of approximately 21 inches. The distance from the lower end of the hook (where the garment engaging arms diverge) to the horizontal strut 68 is between approximately 9 and 10 inches. Referring to FIG. 2, the vertical distance from the strut 68 to the lower end of the hook is between approximately 9 and 10 inches.

In a preferred configuration, the garment engaging arms 66 of the frame 60 define a continuously convex (bowed) surface for engaging the garment. The radius of curvature of the garment engaging arms 66 can be constant or can vary along the length of the arms. The length of the garment engaging arms 66 and the radius of curvature of the convex surface defined by the garment engaging arms are selected to preclude deformation of the garment by the terminal ends of the garment engaging arms. Thus, the garment engages the frame 60 along a curvilinear surface, and the weight bearing length of the garment engaging arms 66 is curvilinear. Further, the curvature of the garment engaging arms 66 is sufficient to preclude the center of mass of the unsupported portion of the garment from draping within the terminal ends of the arms. Further, the radius of curvature of the garment engaging arms 66 decreases such that the arms converge at the joining with the strut 68. Although the garment engaging arms 66 are described in terms of an approximately 21 inch width, it is understood that the desired curvature can be employed in a smaller width frame to accommodate smaller garments.

The frame 60 can be formed from any of a variety of materials, such as but not limited to metal, plastics, or elastomers. In one configuration, the frame 60 is formed of a metal wire having a diameter of 0.125 (⅛) inches.

Figure 6:
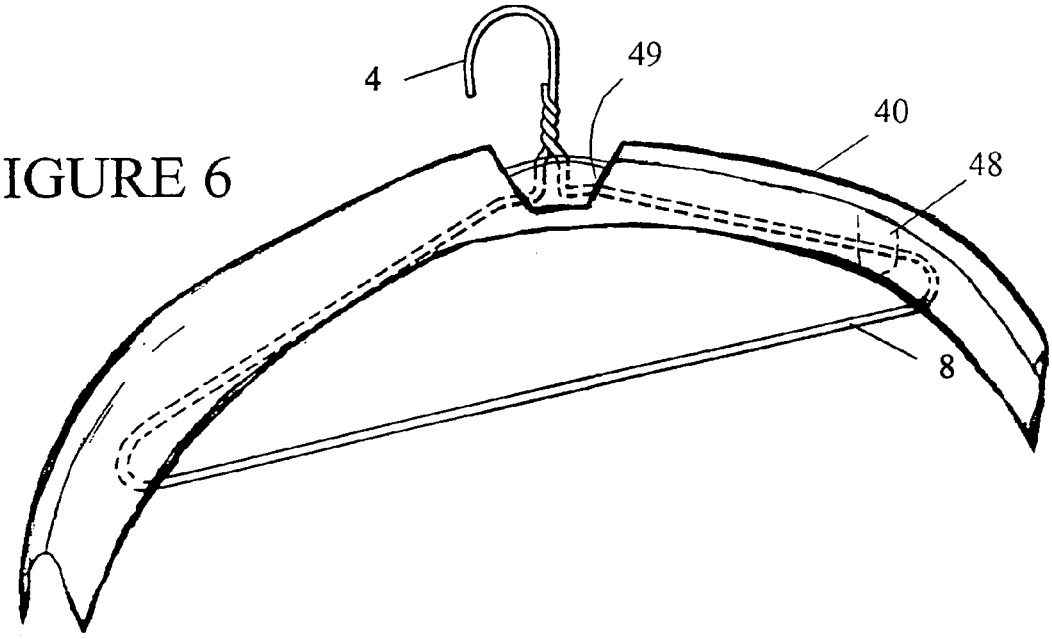
FIG. 6 is a side elevational view showing an overchannel operably engaged with the traditional garment hanger.
Figure 7:
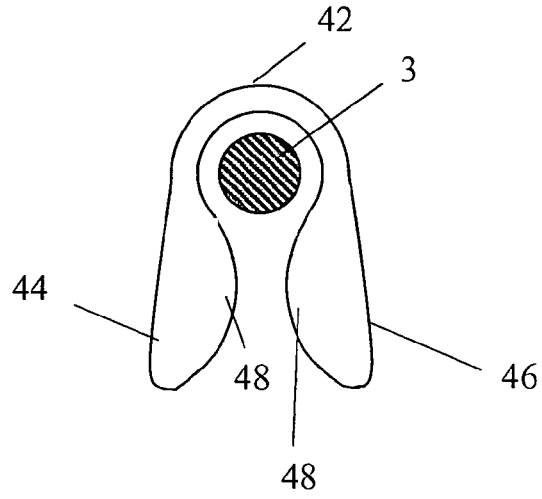
FIG. 7 is a cross-sectional view showing the overchannel with the traditional garment hanger.
Figure 8:
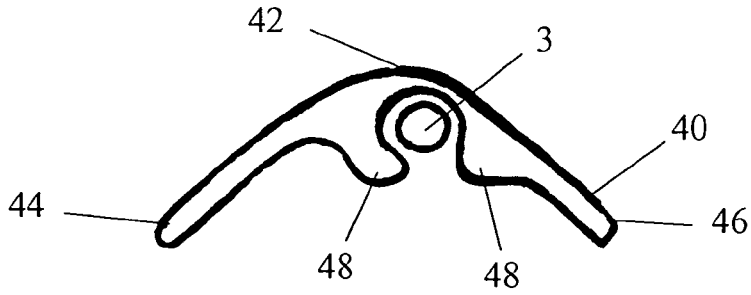
FIG. 8 is a cross-sectional view showing an alternative construction of the overchannel with the traditional garment hanger.

The frame 60 can be employed in connection with a polymeric sheath 20 or an overchannel 40 (shown in FIG. 6).

Figure 3:
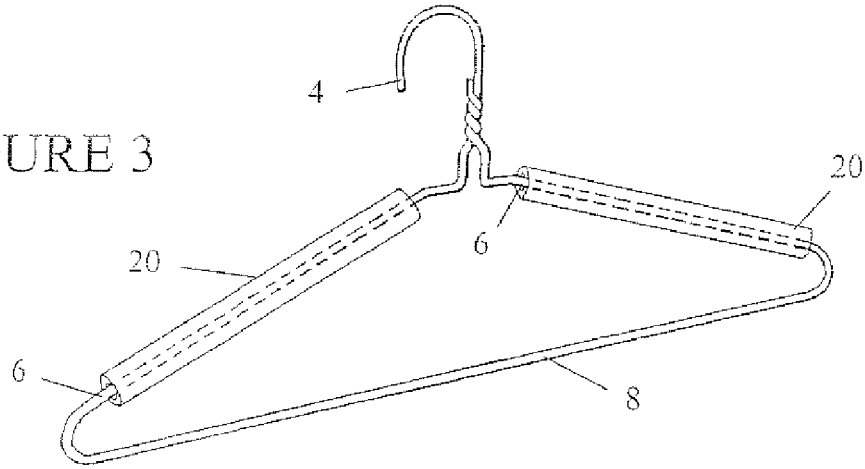
FIG. 3 is a side elevational view of a traditional garment hanger including the present polymeric sheath.
Figure 4:
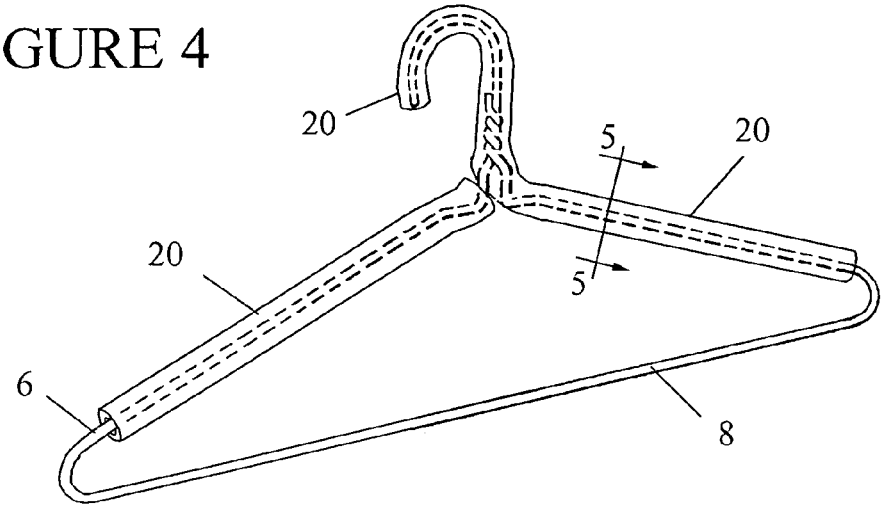
FIG. 4 is a side elevational view of the traditional garment hanger including an alternative construction of the polymeric sheath.

As seen in FIGS. 3 and 4, in a further configuration, the present invention provides a polymeric sheath 20 disposed along at least a portion of the frame 3. The polymeric sheath 20 can be operably disposed about the frame 3 by any of a variety of mechanisms including overmolding and sleeve mounting. While the polymeric sleeve is described in terms of the traditional hanger 3, it is understood the polymeric sheath can be employed with the present frame 60.

Figure 5:
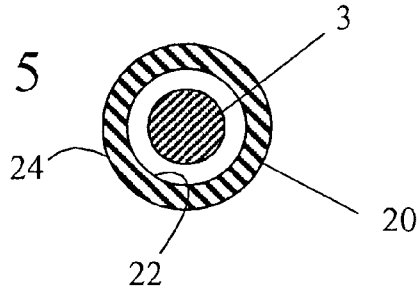
FIG. 5 is a cross-sectional view taken along lines 5—5 of FIG. 4.

In one embodiment, as seen in FIG. 5, the polymeric sheath 20 is preformed to have any given inner diameter of 22 and a given outer diameter 24. Typically, the inner diameter 22 is selected to receive a cross section of the frame 3. Although the inner diameter 22 can be a variety of sizes with respect to a given cross section of the frame, the inner diameter is preferably selected to receive the cross section of the frame while providing friction contact with the frame 3. The sizing of the inner diameter 22 can be at least partially determined by the intended construction of the hanger 2. That is, if the sheath 20 is to be slid onto a length of the frame 3, the inner diameter 22 can be sized to allow the wire to slide along the inner diameter. Alternatively, if the polymeric sheath 20 is to be transversely slipped over the wire, then the inner diameter 22 can be smaller than the diameter of the frame. That is, the polymeric sheath 20 may not completely circumscribe the cross section of the wire, but rather extend a portion of the periphery, such as preferably at least 270°.

The outer diameter of the polymeric sheath 20 can be selected to provide any of a variety of contact surfaces for the garment. For example, the outer diameter 24 of the polymeric sheath 20 can be as much as 2 times to over 10 times the diameter of the encompassed frame. Thus, a wall thickness of the polymeric sheath 20 can be selected to provide any of a variety of performances for the sheath.

The polymeric sheath 20 is selected of a material to substantially preclude degradation, discoloration, or staining of the garment contacting the polymeric sheath. Further, the polymeric sheath 20 is selected to preclude degradation, discoloration, or staining of the garment independent of the moisture of the garment. In addition, an outer surface of the polymeric sheath 20 can be treated or formed to provide either increased or decreased coefficient of friction. The coefficient of friction can be selected in response to the intended garments to be retained on the hanger.

Referring to FIGS. 3 and 4, the polymeric sheath 20 can be configured to encapsulate selected portions of the frame 3, substantially the entire frame, or the entire length of the frame. For example, the polymeric sheath 20 can be sized to encapsulate only the arms. In this configuration, the polymeric sheath substantially defines the garment contacting surface. Referring to FIG. 5, it is contemplated the polymeric sheath 20 can be concentric with the frame 3. Alternatively, the polymeric sheath 20 can be constructed to be eccentric with respect to the frame 3.

The polymeric sheath 20 can be formed to have a substantially dense configuration, or a cellular configuration. In the cellular configuration, the polymeric sheath 20 can have any of the variety of resiliencies or hardnesses. For example, the polymeric material can be from approximately 25 Shore A to approximately 60 Shore D. The hardness of the polymeric sheath 20 can be selected in view of the anticipated loading or garment weight. Thus, in selected configurations, the polymeric sheath 20 is a different material than the frame 3.

The polymeric sheath 20 can be separately formed as a tube or sleeve having a longitudinally extending cut through a wall of the sleeve. The cut can be a mere incision or, alternatively, a removal of sufficient material to permit passage of the cross section of the frame therethrough.

Alternatively, the polymeric sheath 20 can be formed by an overmolding on the frame 3. The overmolding can be formed at selected locations, or alternatively along the entire length of the frame 3. In the overmolding configuration, it is contemplated that the resulting cross section of the polymeric sheath 20 can be substantially different than the underlying frame 3 and thus provide a custom or configured garment contacting length, which is different than the garment contacting length defined by the underlying arms 6.

It is also contemplated that the polymeric sheath 20 can have a varying density along the longitudinal dimension of the sheath. For example, sections of the sheath 20 can have a first density and second sections of the sheath can have a greater second density. Thus, portions of the sheath can be dense material and remaining portions can be a cellular material.

Figure 10:
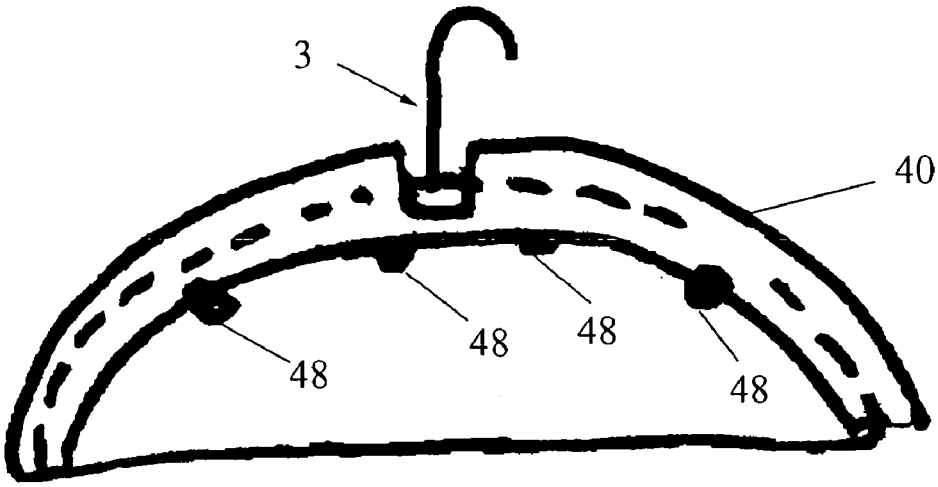
FIG. 10 is a side elevational view of the further construction of the overchannel.
Figure 12:
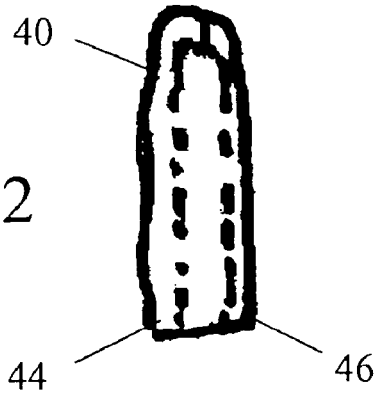
FIG. 12 is a side elevational view of the overchannel of FIG. 10 separated from the hanger.
Figure 11:
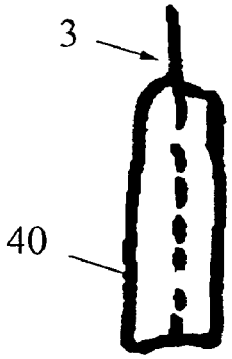
FIG. 11 is an end elevational view of the overchannel of FIG. 10.

Each of the configurations of the polymeric sheath 20 can be employed with a presently described curvilinear (oversized) hanger, as seen in FIGS. 10 and 11. It is also understood that the polymeric sheath 20 can be employed with traditional hangers, thereby increasing the utility and functionality of an existing traditional hanger.

Figure 9:
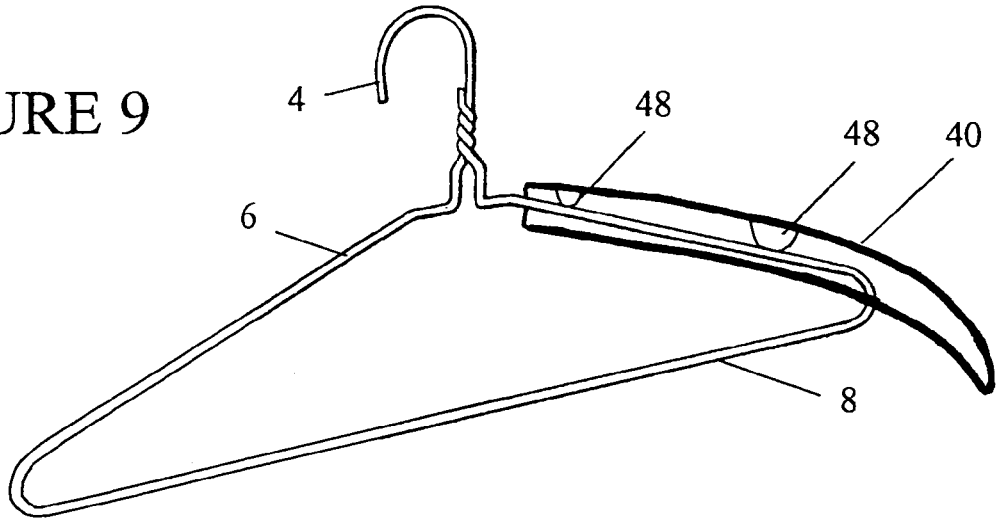
FIG. 9 is a side elevational, partial cutaway view showing the overchannel with the present frame.

Referring to FIG. 6, in the overchannel configuration, an overchannel 40 is selected to alter the garment contacting surface of the frame 3. Preferably, the garment contacting surface area defined by the overchannel 40 is substantially larger than the garment contacting surface area defined by the frame 3. The increased garment contacting surface area can be defined by the cross section of the overchannel 40, as well as a longitudinal dimension of the overchannel with respect to the depending arms 6 of the frame 3. That is, the overchannel 40 can be sized to extend beyond the terminal end of the garment contacting arms 6 of the frame 3. As seen in FIG. 6, the overchannel extends beyond the terminal end of the garment contacting arms 6 of the frame 3 by approximately 40% and in FIG. 9 by approximately 36% of the length of the garment engaging arm. Thus, the overchannel 40 increases the effective size of the hanger, without requiring additional material in the underlying frame 3.

The overchannel 40 can be configured to have a substantially U-shaped cross section defined by a closed end 42 and a pair of extending legs 44, 46. The legs 44, 46 can be substantially parallel, converging, or diverging with respect to the closed end. As seen in FIGS. 7, 8, 12, 14, and 15, the overchannel can have a variety of cross sections.

The overchannel 40 can be formed of a single integral piece of material. Alternatively, it is contemplated that the overchannel 40 can be defined by a first layer forming a first leg 44 and a second layer forming a second leg 46, wherein the first layer and the second layer are bonded together to form the closed end 42. Referring to FIG. 6, the overchannel 40 can include an aperture or notch 49 for passing the hook therethrough.

Referring to FIGS. 7–10 and 14, in one configuration, an inner surface of at least one of the legs 44, 46 includes a capture tab 48 sized to engage a portion of the frame 3, such as the arm 6, to locate the frame intermediate the capture tab and the closed end of the overchannel 40. It is understood that both legs 44, 46 can include capture tabs 48, wherein the capture tabs are opposed to each other or offset along the longitudinal dimension of the overchannel 40.

The capture tabs 48 can be configured to allow removal of the overchannel 40 from the frame 3. Alternatively, the capture tabs 48 can cooperatively engage so as to trap a portion of the frame 3 and substantially preclude nondestructive separation of the overchannel 40 from the frame.

In a further configuration, it is contemplated that the capture tabs 48 can be sized and located such that the longitudinal axis of the overchannel 40 is inclined with respect to the underlying arm 6 of the frame 3. The overchannel 40 and the frame 3 are not coplanar, and the overchannel can provide enhanced support to the garment. Thus, the respective arms of the overchannel 40 can be disposed in intersecting planes.

The overchannel 40 can be configured to provide a substantially different garment contacting surface than the frame 3. The garment contacting surface of the overchannel 40 can be curvilinear, linear, or multifaceted. For example, in one configuration, the overchannel 40 extends beyond a terminal end of the arms 6 of the frame 3. In this configuration, the length of the garment contacting surface of the overchannel 40 is greater than the length of the garment contacting surface of the underlying arm 6 or frame 3. The overchannel 40 is preferably formed of a material to be sufficiently self-supporting so as to maintain the extended length of the garment contacting surface under loading. The overchannel 40 is sufficiently rigid to maintain the garment contacting surface without requiring continuous support of the frame 3. That is, the overchannel 40 does not substantially deform upon retaining a garment such as a winter coat or sweater.

The overchannel 40 can be formed from any of a variety of materials. For example, thermosets, thermoplastics, and thermoplastic elastomers can be employed. Alternatively, the overchannel 40 can be formed from biodegradable products, and paperboard, cardboard and corrugated materials. As in selection of material for the polymeric sheath, the material of the overchannel 40 is selected to be nondegrading and nonstaining to a retained garment. Preferably, the material of the overchannel 40 and the configuration of the overchannel, such as the thickness along the cross section, are selected to render the overchannel self-supporting as it overhangs the arms 6 of the frame 3.

In selected configurations, the overchannel 40 is constructed to define a profile as provided by the garment engaging arms 66. That is, the overchannel 40 defines a garment contacting surface that minimizes or precludes puckering or distortion of the garment.

In one configuration, the frame 3 has arms of a given length, wherein the overchannel 40 has a longitudinal dimension greater than the given length. The overhang or excess length of the overchannel 40 can be selected in part in response to the size of the underlying frame 3 and intended garments to be retained.

Alternatively, as seen in FIGS. 10 and 13, the overchannel 40 can define a substantially curvilinear profile, wherein the curvilinear profile has substantially the same as the density frame. However, it is understood, the overchannel 40 can extend beyond the width of the frame.

It is also understood the overchannel 40 can be employed in conjunction with the polymeric sheath 20. However, in view of market efficiencies, it is anticipated that only one of the overchannel 40 and the polymeric sheath 20 would be used in a given hanger.

It is further recognized the overchannel 40 can be used in connection with the curvilinear hanger. In addition, the overchannel 40 can be selected to cooperatively engage the traditional wire hanger, thereby increasing the functionality of an existing hanger.

While the invention has been described in connection with a presently preferred embodiment thereof, those skilled in the art will recognize that many modifications and changes can be made without departing from the true spirit and scope of the invention, which accordingly is intended to be defined solely by the appended claims.

The invention claimed is:

1. A garment hanger having a frame forming a hook and a pair of depending garment engaging arms and a transverse strut extending between the garment engaging arms, the garment hanger comprising:

(a) continuously convex length in each of the garment engaging arms, the convex length substantially extending from the hook to the strut; and (b) a polymeric sheath extending along at least one of the garment engaging arms, the polymeric sheath circumscribing the garment engaging arm along a length of the garment engaging arm.

2. The garment hanger of claim 1, wherein the polymeric sheath extends along both garment engaging arms.

3. The garment hanger of claim 1, wherein the polymeric sheath is concentric with the one of the garment engaging arms.

4. The garment hanger of claim 1, wherein the polymeric sheath is eccentric with the one of the garment engaging arms.

5. The garment hanger of claim 1, wherein the polymeric sheath has a cellular structure.

6. The garment hanger of claim 1, wherein the polymeric sheath is an overmolding.

7. The garment hanger of claim 1, wherein the polymeric sheath is a separable sleeve.

8. The garment hanger of claim 7, wherein the separable sleeve includes a longitudinally extending slit for receiving a cross section of the garment engaging arm.

9. The garment hanger of claim 1, further comprising a second polymeric sleeve extending along the hook.

10. The garment hanger of claim 1, wherein the polymeric sheath is a sleeve having a circular cross section with an outer diameter at least twice a diameter of the garment engaging arm.

11. A method of forming a garment hanger, comprising:

(a) forming a frame having a hook, a pair of depending garment engaging arms and a transverse strut extending between the garment engaging arms, the garment engaging arms having a continuously convex length substantially extend from the hook to the strut; and (b) forming a polymeric encapsulation on the garment engaging arms.

12. The method of claim 11, wherein forming the polymeric encapsulation includes overmolding a polymeric material about the portion of the metal hanger.

13. The method of claim 11, wherein forming the polymeric encapsulation includes disposing a preformed polymeric sleeve over the portion of the metal hanger.

14. An accessory for a garment hanger having a hook and a pair of garment engaging arms, the garment engaging arms having a longitudinal axis, the accessory comprising:

(a) an overchannel having a generally U-shape cross section defined by a closed end and a pair of legs, and a channel longitudinal axis, the closed end including an aperture sized to pass the hook therethrough, the channel longitudinal axis being different than the longitudinal axis of the garment engaging arm, the overchannel extending beyond a terminal end of the garment engaging arm by approximately 40% of a length of the garment engaging arm.

15. The accessory of claim 14, wherein the overchannel is an integral one piece body.

16. The accessory of claim 14, wherein the overchannel includes a first layer defining the first leg and a second layer defining the second leg, the first layer and the second layer bonded together to form the closed end.

17. The accessory of claim 14, wherein an inner surface of at least one of the legs includes a capture tab, sized to retain a section of the garment engaging arm intermediate the capture tab and the closed end.

18. The accessory of claim 14, wherein the overchannel is an integral one piece construction and is sized to extend beyond a terminal end of each garment engaging arm.

19. The accessory of claim 14, wherein the legs include a plurality of capture tabs sized to retain the garment engaging arm relative to the overchannel.

20. The accessory of claim 19, wherein the plurality of capture tabs engages a first garment engaging arm having a first longitudinal axis and a second garment engaging arm having a different second longitudinal axis.

* * * * *